US005354144A

United States Patent [19]

Lizakowski

[11] Patent Number: 5,354,144

[45] Date of Patent: Oct. 11, 1994

[54] ADJUSTABLE AND RECOVERABLE VERTICAL ASSEMBLY

[76] Inventor: Allen J. Lizakowski, 4414 Black Walnut Woods, San Antonio, Tex. 78249

[21] Appl. No.: 146,443

[22] Filed: Oct. 29, 1993

[51] Int. Cl.[5] ..... E01F 9/00

[52] U.S. Cl. ..... 404/10; 40/612

[58] Field of Search ..... 404/6, 9, 10, 11, 12, 404/13; 40/612; 256/13.1; 116/63 P

[56] References Cited

U.S. PATENT DOCUMENTS

| | | | |
|---|---|---|---|
| 3,838,661 | 10/1974 | Medley, Jr. | 40/612 X |
| 4,084,914 | 4/1978 | Humphrey et al. | 404/10 |
| 4,092,081 | 5/1978 | Schmanski | 404/10 |
| 4,106,879 | 8/1978 | Diedershagen | 404/10 |
| 4,123,183 | 10/1978 | Ryan | 404/10 |
| 4,240,766 | 12/1980 | Smith et al. | 404/10 |
| 4,270,873 | 6/1981 | Laehy et al. | 40/612 X |
| 4,343,567 | 8/1982 | Sarver et al. | 404/10 |
| 4,588,324 | 5/1986 | Goellner | 404/10 |
| 4,636,108 | 1/1987 | Duckett | 404/10 |
| 4,636,109 | 1/1987 | Clausen et al. | 404/10 |
| 4,806,046 | 1/1989 | Clark et al. | 404/10 |
| 4,926,592 | 5/1990 | Nehls | 256/13.1 X |
| 5,199,814 | 4/1993 | Clark | 404/10 |

*Primary Examiner*—Ramon S. Britts
*Assistant Examiner*—James A. Lisehora

[57] ABSTRACT

An adjustable and recoverable vertical assembly comprised of a post containing a load cell, mounted to a base, capable of recovering its original vertical and horizontal orientation after an impact with a moving object, with the additional capability of accepting attachments of various types and sizes. A low profile signage panel so designed to provide a surface with no protruding edges to be snagged during a vehicle collision, that may be attached to the vertical assembly. Attachments capable of being mounted on top of the vertical assembly that enable it to be utilized as a sign stanchion or a base for objects requiring a horizontal mounting surface.

6 Claims, 5 Drawing Sheets

ADJUSTABLE AND RECOVERABLE VERTICAL ASSEMBLY

BACKGROUND OF THE INVENTION

The present invention pertains in general to stationary highway marker posts and more particularly to posts having the characteristics of self restoration after a collision with a moving object. Delineator posts for marking roadways and identifying the existence of hazards are frequently accidentally struck by vehicles straying off the designated travel way. The need therefore was presented to provide characteristics for automatic restoration once the post was contacted. A proliferation of designs have been presented which provided for this restoration capability in various ways, but inherent in present designs, there is exhibited a tendency to pivot when uprighted, to not possess the feature of tension adjustability without complete disassembly, and to not have the capability of adapting to various other attachments when so required.

Consequently, it is desirable to provide an assembly which would incorporate all aforementioned features into one design.

SUMMARY OF THE INVENTION

The present invention is an improved vertical assembly comprised of a post capable of uprighting itself after being impacted by a moving object; additionally providing for simplified assembly, adjustment and repair and being equipped with the options of attaching a signage panel so designed to provide for a minimal surface area to be snagged during a collision.

It also may be optionally equipped to provide for attachments of posts of varying lengths or with hardware to accomplish various other functions.

Further objects and advantages of the invention will be set forth in the following specification and will be obvious therefrom without being specifically referred to, the same being realized and obtained as will be pointed out in the claims hereof.

THE PRIOR ART

U.S. Pat. Nos. 5,199,814 and 4,806,046 exhibits a design of a delineator post with similar capabilities of the current invention, but still exhibit the characteristic whereby the post may be pivoted at the juncture of its load cell elements after an impact. Additionally, the compression spring held in place by cable stops could become a projectile if the aforementioned lower cable stop failed while the spring was in a compressed state such as during an impact, and could be propelled elsewhere if the compression existing in the pneumatic sealed delineator post tube allowed the tuve to become dislodged from its load cell. Additionally, the signage affixed to the post structure exhibits acute turning angles on the lower extremeties, leading to possible snagging onto a contacted surface.

Tension springs such as are utilized in the current invention do not exhibit a large amount of stiffness when compared to compression springs and therefore do not characterize themselves as such a potentially formidable projectile if accidentally released.

Related designs of structures as exhibited in U.S. Pat. Nos. 4,084,914; 4,092,081; 4,123,183; 4,343,567; 4,106,878; 4,588,324; 4,636,108; and 4,636,109 when compared to the current invention do not possess all the characteristics of returning exactly to their original position when impacted, are not tension adjustable to conform to varying stress loads, and do not have the characteristics of readily adapting to other functions other than that for which they were originally intended.

BRIEF DESCRIPTION OF THE DRAWINGS

For a more complete understanding of the nature and objects of the invention as briefly summarized above, reference may be had to the appended drawings which form a part of this specification in which.

DESCRIPTION OF THE PREFERRED EMBODIMENTS

Figure 1:
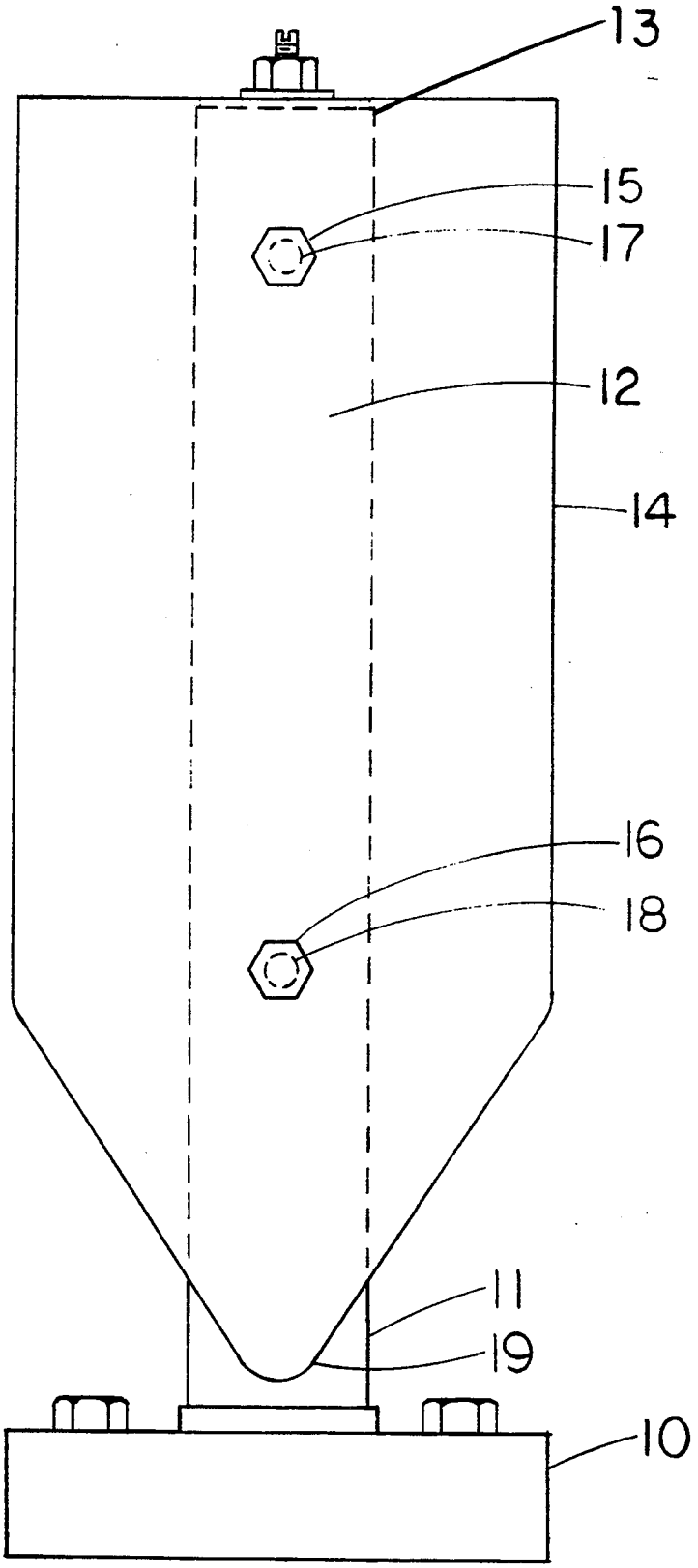
FIG. 1 is an elevational view of the adjustable and recoverable vertical assembly.

Referring now to the drawings and first to FIG. 1, a vertical assembly is illustrated incorporating a base 10 that supports a vertical post 11 constructed of highly resilient and impact resistant material such as polypropylene or other similar polymer materials, containing the load cell 12 that is capped and supported by washer assembly 13. The vertical post 11 is provided with a reflective signage panel 14 made of a high impact polymer material and covered with a reflective surface which may suitably attached with fasteners 15 and 16 through orifices 17 and 18 to provide a firm sign attachment to the vertical post. The aforementioned panel 14 is designed with a low profile leading edge 19 curved and tapered at its lowest extremity, then extended upward at an acute angle toward the wider portion of the upper panel section, which is rectangular in shape and designed to be covered with the reflective surface. This design characteristic enables the panel 14 to prevent being snagged by objects it comes in contact with and presents excellent aerodynamic characteristics when the panel is in an other than totally vertical position such as when confronted by severe wind forces or turbulance created by oncoming objects or by objects that come in contact with the panel, thus helping to prevent distortion.

Figure 2:
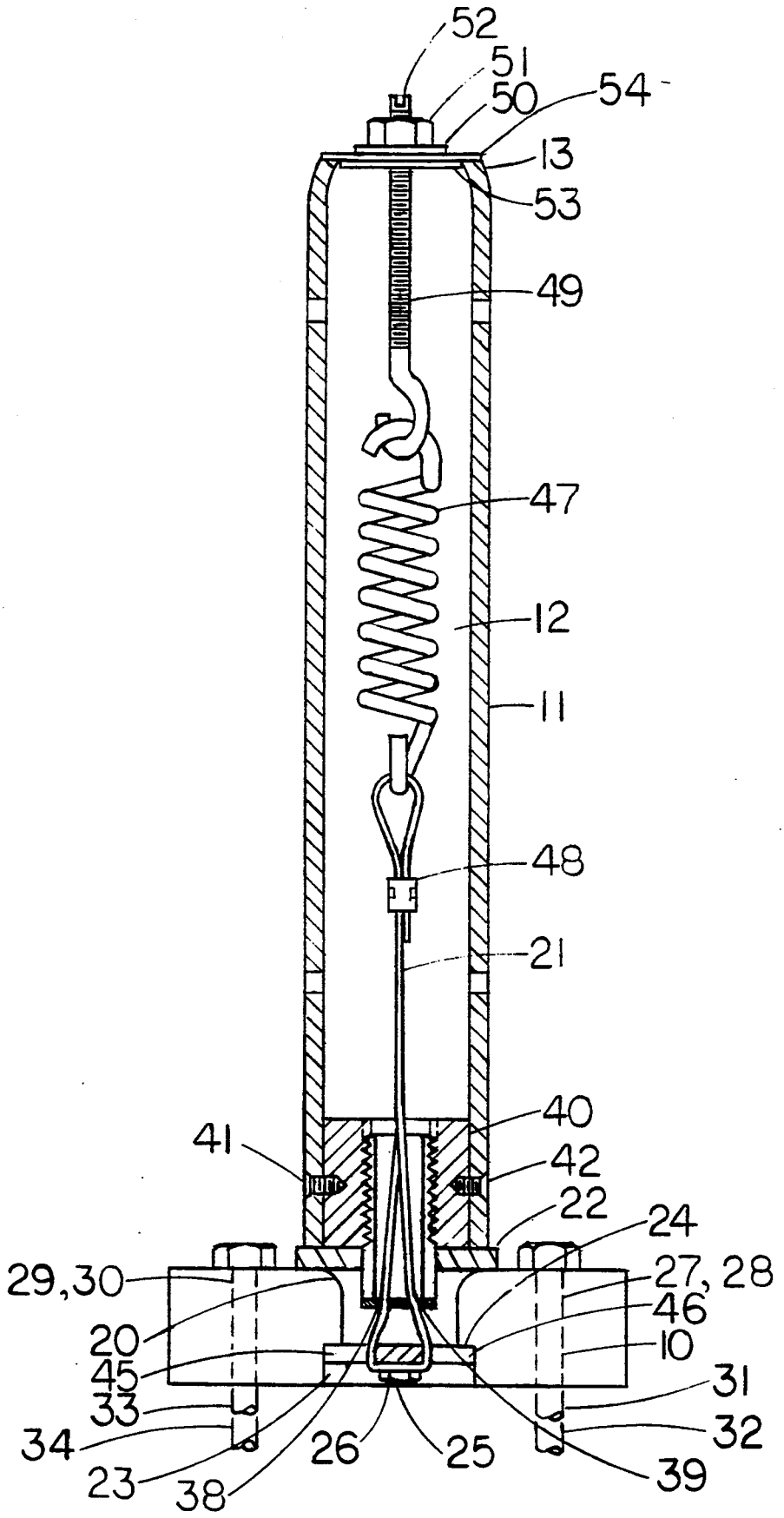
FIG. 2 is a sectional view of the post assembly illustrating construction of the load cell elements.

As shown in FIG. 2, the present invention is sectionalized to illustrate the components of the load cell 12 that is encased in vertical post 11, supported by base 10, and adjusted at washer assembly 13 for proper tension.

Figure 7:
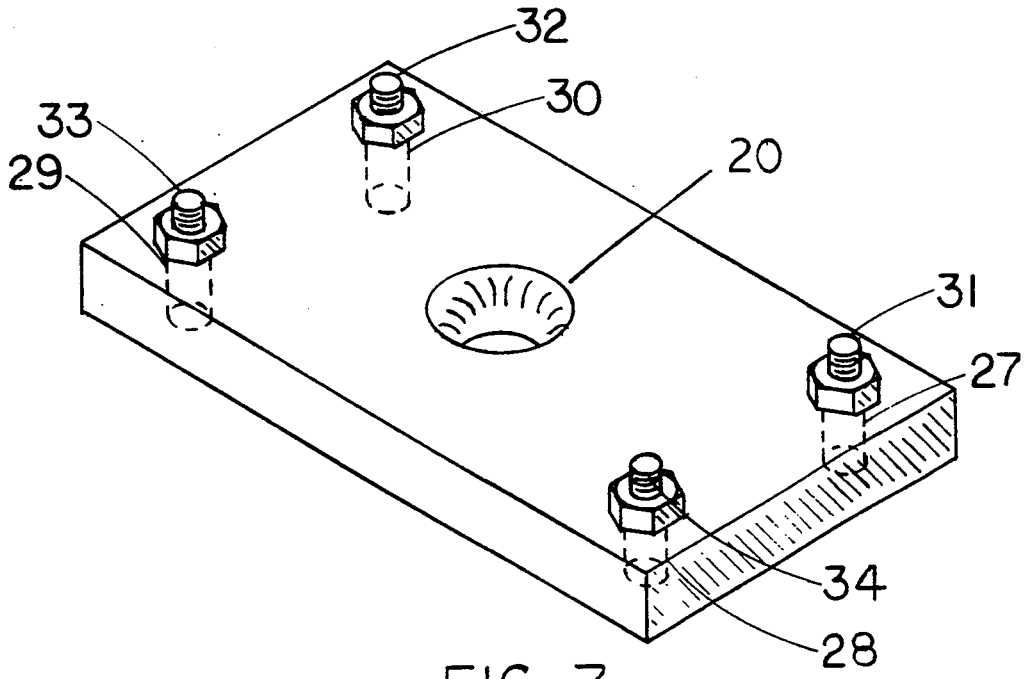
FIG. 7 is an isometric view of the base of the vertical assembly with the addition of an optional base insert.

The base 10 is constructed of a high strength polymer material and is equipped with an orifice 20 through which the load cell support cable 21 passes and where the alignment flange 22 is housed when the vertical assembly is in a vertical position. The base 10 is additionally provided with a recess 23 where the retaining bar 24 is located and is attached by fasteners 25 and 26. Referring now to FIG. 7 the base 10 is also provided with orifices 27, 28, 29, and 30 that may contain fasteners 31, 32, 33, and 34 that fasten the base 10 to another surface. Base 10 may also be bonded to a road surface with an epoxy bonding material that may be extruded through orifices 27, 28, 29, and 30 to increase adhesion to the road surface.

Figure 4:
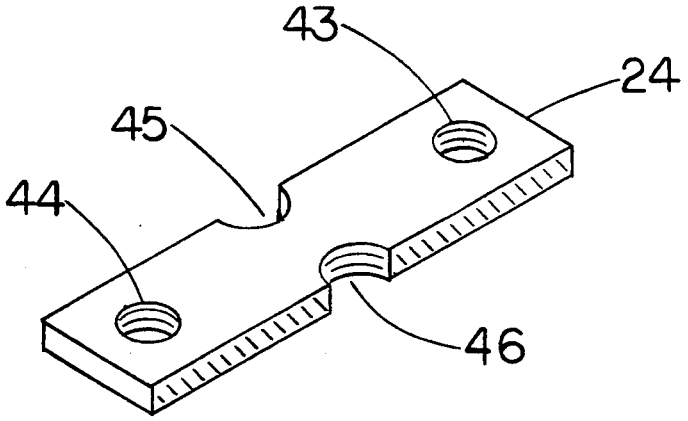
FIG. 4 is an isometric view of the retaining bar.

Referring now to FIG. 4, the retaining bar 24, consists of a flat section of steel that is provided with orifices 43 and 44 at the two ends of the plate, for mounting, and is provided with cutouts 45 and 46. Referring now to FIG. 2, the retaining bar 24 is attached to base 10 in recess 23 by fasteners 25 and 26.

Figure 3:
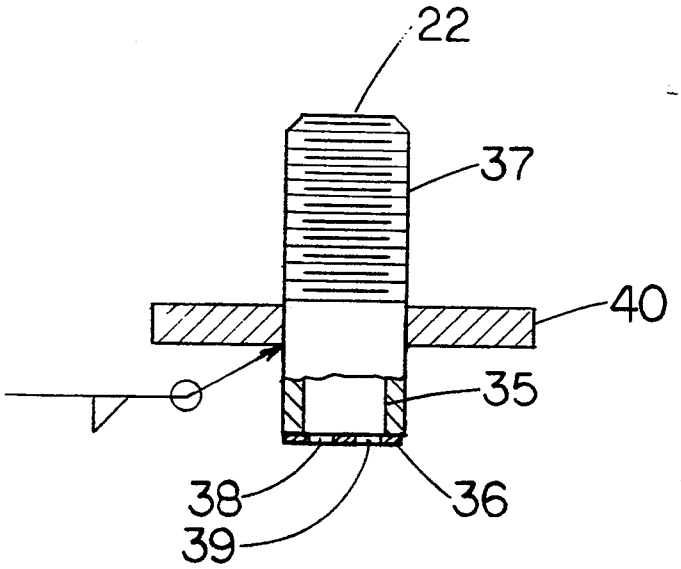
FIG. 3 is a cross sectional view of the alignment flange illustrating the cable position with the base detached.

Referring again to FIG. 2, the base 10 provides the platform for alignment flange 22, which is exhibited in FIG. 3. Referring now to FIG. 3, alignment flange 22 consists of a tubular section 35, sealed on the lower tubular end 36, that is threaded with standard threads 37 on the upper portion. It is provided with orifices 38 and 39 that have been drilled through the sealed lower portion of the tube at diametrically opposed locations on the inner diameter of the tube. Washer 40 is attached at a right angle to and at the lower extremity of the threaded section of tubular section 35 to complete the assembly of alignment flange 22.

Referring again to FIG. 2, alignment flange 22 is secured into the interior threaded portion of standard plastic adapter sleeve 40. The vertical post 11 is then placed over the exterior surface of standard plastic adapter sleeve 40 until the lower surface of vertical post 11 contacts the washer surface of alignment flange 22. The vertical post 11 is then secured to standard plastic adapter sleeve 12 with self threading screws 41 and 42.

The two extremeties of load cell support cable 21 are initially placed along the concave surfaces 45 and 46 and looped around the lower surface of retaining bar 24. They they pass through the center orifice 20 of base 10, then through the orifices 38 and 39 and through the tubular section of alignment flange 22. The two extremeties of load support cable 21 then enter tubular post 11 and pass through the opposing sides of the lower loop of expansion spring 47. The entire looped portion of load cell support cable 21 is then attached with cable stop sleeve member 48.

The upper loop of expansion spring 47 is passed through the lower loop of eye bolt 49. The upper threaded portion of eye bolt 49 is then passed through washer assembly 13 and is terminated at the top of washer assembly 13 with washer 50 and nut 51. The insertion of a screwdriver into slot 52 of eye bolt 49 coupled with the tightening of nut 51 accomplishes adjustment of load cell 12 to any desired tension.

Washer assembly 13 is formed by welding a standard washer 53, whose outer diameter is less than the inner diameter of tubular post 11, to the lower horizontal surface of standard washer 54, whose outer diameter is equal to the outer diameter of tubular post 11. This assembly will prevent the lower surface of standard washer 54 from sliding across the upper surface of tubular post 11 when washer assembly 13 is secured against tubular post 11 as load cell 12 is placed in a tensioned state.

Figure 5:
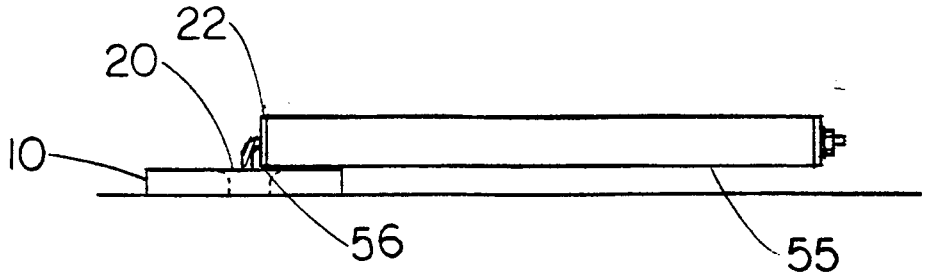
FIG. 5 illustrates the response of the vertical assembly in a horizontal position with the lower portion of the alignment flange missing.

Referring now to FIG. 5, the vertical assemnbly 55 is shown in a horizontal position after impact, illustrating the potential of recovery to the vertical position with the lower portion of alignment flange 22 removed. The fulcrum point 56 between the base 10 and the vertical assembly 55 is in the center of orifice 20. When the vertical assembly 55 attempts to upright itself, the lower rounded edge will tend to remain stable against the sides of orifice 20 and full upright positioning may not be achieved.

Figure 6:
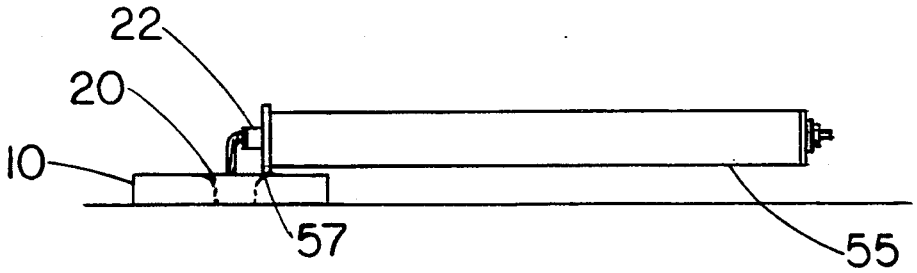
FIG. 6 illustrates the response of the vertical assembly in a horizontal position with the alignment flange being illustrated as the proposed design.

Referring now to FIG. 6, where the vertical marker assembly 55 is again in a horizontal position, the fulcrum point 57 has now shifted to the exterior surface of orifice 20 on base 10 due to the addition of the lower portion of alignment flange 22. This shifting of fulcrum point 57 will place the lower rounded edge of vertical assembly 55 on a flat surface and restoration to the full vertical position will consistently occur.

Referring now to FIG. 2, the consistent alignment of vertical post 11 to base 10 to its original orientation is accomplished when alignement flange 22 travels along cable 21 as vertical post 11 returns to the vertical position. As alignment flange 22 nears retaining bar 24, the tensioning of cable 21 will direct two lower orifices 38 and 39 to be directed toward the two concave surfaces 45 and 46 of retaining bar 24, thus returning vertical post 11 to the original orientation position it assumed prior to impact.

Figure 8:
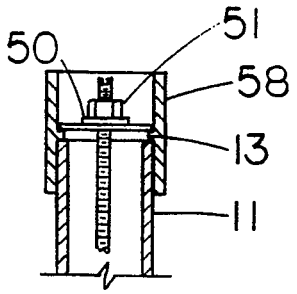
FIG. 8 is a cross sectional view of a coupling added to the vertical assembly that permits additional attachments above the load cell.

Referring now to FIG. 8, an optional addition to the top of vertical post 11 is illustrated when the vertical assembly is utilized for functions other than were originally intended. A standard plastic coupling 58 is added to vertical post 11 prior to the attachment of washer assembly 13, washer 50 and nut 51. This will permit pipe extensions or other optional attachments to be added to vertical post 11.

Figure 9:
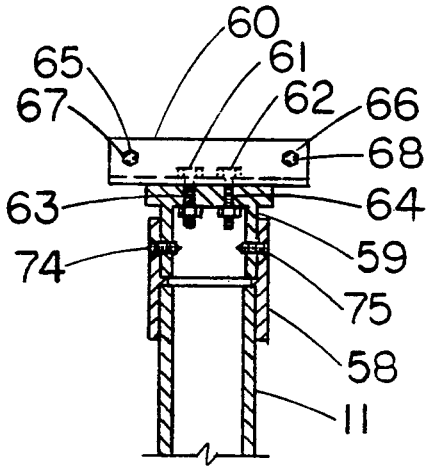
FIG. 9 illustrates an isometric view of an optional attachment that may be utilized to attach a sign to the vertical assembly.

Referring now to FIG. 9, an optional insert for plastic coupling 58 is shown to permit the vertical assembly to be utilized as a sign stanchion. Standard plastic plug 59 is provided with orifices 63 and 64 through which pass fasteners 61 and 62 to permit a section of aluminum channel 60 to be mounted to cap 59. The aluminum channel 60 is then provided with threaded orifices 65 and 66 which enable fasteners 67 and 68 to secure a sign placed through the center of aluminum channel 60.

Figure 10:
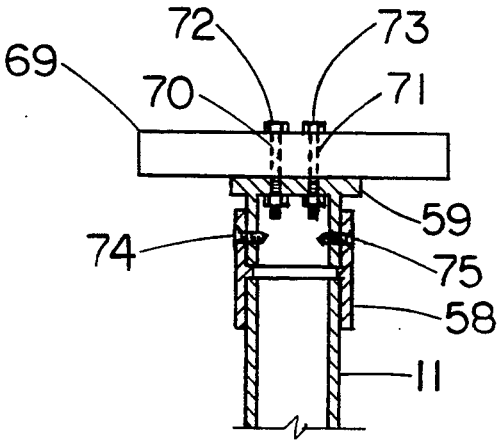
FIG. 10 illustrates an isometric view of an optional attachment that may be utilized to mount objects in a horizontal position on top of the vertical assembly.

Referring now to FIG. 10, there is shown another optional insert for plastic coupling 58 to permit vertical post 11 to be utilized as a base for such items as mailboxes, lights, bird houses and other similar attachments which require a horizontal mounting surface. Standard plastic plug 59 is again provided with orifices 70 and 71 through which fasteners 72 and 73 pass to permit attachment of horizontal rectangular plate 69.

Although the preferred embodiment has been described in detail, it should be understood that various changes, substitutions and alterations may be made therein without departing from the spirit and scope of the invention as devined by the appended claims.

I claim as my invention:

1. A self uprighting vertical assembly comprising:

(a) a base having a center and being adapted to be attached to any suitable surface, said base comprising (1) an orifice disposed approximately in the center of said base, (2) a rectangular plate having a bottom, two longitudinal sides, and two extremities, said rectangular plate being approximately centered on said orifice and recessed in the bottom of said base, said rectangular plate being provided with an orifice at each of the extremities of said rectangular plate for attachment with fasteners to said base, and said rectangular plate being provided with a concave groove located at an approximate center of each of the two longitudinal sides of said rectangular plate and a plurality of orifices disposed on the extremities of said rectangular base through which fasteners or a bonding material may be passed to attach said rectangular base to any suitable surface, and (b) an alignment flange having a vertical tube with a lower end sealed by a lower sealing plate, approximately an upper half of said vertical tube being threaded with standard pipe threads, and said upper half of said tube being distinguished from a lower half by a washer placed over and secured to said vertical tube, the lower sealing plate of said vertical tube having two lower orifices, and (c) a tubular adapter of polymer material having an inside surface threaded with standard pipe threads, designed to accept insertion of said vertical tube, and (d) a tubular post of polymer composition having side walls and a top and having an inside diameter of equal proportion to an exterior diameter of said tubular adapter, a plurality of orifices through the side walls of said tubular post, said orifices being provided to be fitted with fasteners to permit attachment of signage to said tubular post and to secure said tubular post to said tubular adapter, and said tubular post containing and supporting an internal load cell having a lower termination point, and (e) an interconnecting cable looped around said rectangular plate in said base then entering said lower orifices in said lower sealing plate, then entering said tubular post, looping through the lower termination point of said load cell in said tubular post and thereafter, terminating with a cable stop sleeve, said cable thereby securing all elements of said vertical assembly.

2. The improvement of claim 1, wherein the load cell contained in the tubular post further comprises:

(a) an expansion spring having a lower loop and an upper rung, said lower loop acting as the lower termination point of said load cell, and (b) an eye hook coupled to the upper rung of said expansion spring, said eye hook extending vertically upward through the top of said tubular post, said eye hook having an upper horizonal surface and a threaded portion, said upper horizontal surface being notched with a vertical groove, and (c) a washer assembly placed over the threaded portion of said eye hook, said washer assembly including an upper washer welded to a lower washer, wherein said upper washer has an outer rim with an outside diameter equal to an outside diameter of said tubular post with said lower washer having an outside diameter minutely less than the inside diameter of said tubular post, with the outer rim of said washer assembly placed on top of said tubular post, and (d) a standard washer placed over the threaded portion of said eye hook, and placed on top of said washer assembly, and (e) a standard nut, threaded on the threaded portion of said eye hook to complete the assembly of said load cell, with said load cell being adjustable by interaction between said standard nut and said vertical groove on said eye hook.

3. The improvement of claim 1 wherein:

a signage panel of high impact polymer composition is attached with fasteners to said tubular post, said signage panel having an upper section of a rectangular shape and a lower section with the shape of an isosceles triangle, a lower point of said isosceles triangle having a rounded surface to prevent snagging of foreign objects.

4. The improvement of claim 1 wherein:

a standard polymer coupling of an inside diameter equal to the outside diameter of said tubular post is placed on top of said tubular post prior to the placement of said washer assembly.

5. The improvement of claim 4 further comprising:

a standard polymer plug with an outside diameter equal to the inside diameter of said standard polymer coupling, said standard polymer plug being designed to be inserted into said standard polymer coupling and secured with fasteners through orifices in an exterior wall of said standard polymer coupling, wherein said standard polymer plug has a top horizontal surface with a section of aluminum channel fastened thereto, a plurality of fasteners passing through orifices disposed vertically through a bottom of said aluminum channel and a top of said standard plug, and said aluminum channel being provided with a plurality of threaded orifices passing through said aluminum channel, wherein a plurality of fasteners are provided to be inserted into said threaded orifices to affix signage into said aluminum channel.

6. The improvement of claim 4 further comprising:

a standard polymer plug with an outside diameter equal to the inside diameter of said standard polymer coupling, said standard polymer plug being designed to be inserted into said standard polymer coupling and secured with fasteners through orifices in an exterior wall of said standard polymer coupling, wherein said standard polymer plug has a top horizontal surface with a rectangular base fastened thereto, wherein said rectangular base is attached to said standard polymer plug with a plurality of fasteners disposed vertically through the top horizontal surface of said standard polymer plug and through said base, wherein said base is provided for supporting objects on said base that require a horizontal mounting surface.

* * * * *